US005338145A

United States Patent [19]

Beretta

[11] Patent Number: 5,338,145

[45] Date of Patent: Aug. 16, 1994

[54] MOTOR VEHICLE AUTOMATIC PARKING SYSTEM, AND RELATED IMPROVED SILOS STRUCTURE

[76] Inventor: Fausto Beretta, Via Pongiana, 1, CH-6949 - Comano, Switzerland

[21] Appl. No.: 100,341

[22] Filed: Aug. 2, 1993

Related U.S. Application Data

[63] Continuation of Ser. No. 767,068, Sep. 27, 1991, abandoned.

[51] Int. Cl.[5] ..... E04H 6/12

[52] U.S. Cl. ..... 414/254; 414/231; 414/255

[58] Field of Search ..... 414/233–235, 414/239, 241–242, 244, 253–257, 261–262, 231

[56] References Cited

U.S. PATENT DOCUMENTS

| | | | |
|---|---|---|---|
| 2,901,129 | 8/1959 | Sanders | 414/256 X |
| 3,180,500 | 4/1965 | Alimanestianu et al. | 414/262 X |
| 3,232,454 | 2/1966 | Coursex | 414/237 |
| 3,366,254 | 1/1968 | Peter | 414/254 |
| 3,608,748 | 9/1971 | Wilson | 414/239 |
| 3,710,957 | 1/1973 | Small | 414/253 X |
| 3,756,432 | 9/1973 | McCreary | 414/257 X |
| 3,896,955 | 7/1975 | Collins et al. | 414/254 |
| 3,984,012 | 10/1976 | Ennis et al. | 414/231 |
| 4,079,847 | 3/1978 | Kochanneck | 414/256 |
| 4,170,310 | 10/1979 | Bajulaz | 414/241 |
| 4,265,581 | 5/1981 | Ives et al. | 414/254 X |
| 4,768,914 | 9/1988 | Sing | 414/235 X |
| 4,936,730 | 6/1990 | Morioka | 414/239 |
| 4,950,117 | 8/1990 | Go | 414/235 X |
| 4,976,580 | 12/1990 | Knakrick | 414/254 |
| 5,018,926 | 5/1991 | Sternad | 414/253 |
| 5,024,571 | 6/1991 | Shahar et al. | 414/231 |
| 5,037,263 | 8/1991 | Yamashita | 414/254 |
| 5,049,022 | 9/1991 | Wilson | 414/253 |
| 5,116,182 | 5/1992 | Lin | 414/254 |
| 5,118,239 | 6/1992 | Morioka | 414/235 |

FOREIGN PATENT DOCUMENTS

| | | | |
|---|---|---|---|
| 0210170 | 8/1990 | Japan | 414/255 |
| 2183619 | 6/1987 | United Kingdom | 414/253 |
| 9007043 | 6/1990 | World Int. Prop. O. | 414/234 |

*Primary Examiner*—Michael S. Huppert
*Assistant Examiner*—James W. Keenan

[57] ABSTRACT

Automated parking system for motor vehicles in silos including cells, carports, corridors, ramps and the like, in which the motor vehicle is carried using lifting and translating devices. The vehicles arrive at a loading floor with access to loading/unloading cabins. The loading floors have an elevator compartment arranged along the major axis of a motor vehicle. The lifting and translating devices move inside the elevator compartment and the vehicles are picked up by translating elements in the elevator compartment, and are then transported to positioning cells located on several parking floors. The system includes comb-like supports including several mobile pieces which can be opened and closed for supporting the motor vehicles.

5 Claims, 8 Drawing Sheets

MOTOR VEHICLE AUTOMATIC PARKING SYSTEM, AND RELATED IMPROVED SILOS STRUCTURE

This is a continuation of application Ser. No. 07/767,068 filed on Sep. 27, 1991, now abandoned.

BACKGROUND OF THE INVENTION

1. Field of the Invention

The present invention relates to an automated parking system for motor vehicles in silos including cells, carports, corridors, ramps and the like. The motor vehicle is carried by lifting and translation devices, including, for example, one or more elevators which move along a vertical (Z) axis and two or more trolleys which move along two directions (X,Y) in a plane perpendicular to the vertical axis.

2. Description of the Related Art

The construction of conventional car parks are mainly based on driving of vehicles through long ramps and corridors up to carports. These systems require large surfaces. They have slow circulation speed, and they are greatly limited with regard to car space capacity, that is, the possibility of expanding aboveground and underground because of the serious atmospheric pollution problems (high concentration of exhaust gases inside the parking building), which markedly increases when the silos are expanded. Systems of the type according to patent applications EP-A-0351374 and CH-A-670129 have developed in order to meet the ever increasing demand for car parks. These systems make the best use of the ever more limited areas available for their construction.

These systems have advantages, such as the areas employed and the security of the parked vehicle, but they still lack speed, operating capacity, efficiency, yield, reduced costs and availability at the highest information technology levels (to quote only a few of the main deficiencies of the above-mentioned systems). Thus they are not competitive with the traditional silos.

SUMMARY OF THE INVENTION

The first object of the present invention is to have a system that eliminates the inconveniences discussed above and allows maximization of system performance.

Another object of the invention is to provide simple, efficient systems with low production, installation and operating costs.

These objectives and other objectives are obtained by a system according to the present invention wherein vehicles arrive at a single pick-up point or loading floor with access to loading and unloading cabins, the pick-up point also includes an elevator compartment. A motor vehicle is arranged inside one of the cabins, with the car's major axis parallel to the opening of the elevator compartment, or the motor vehicle is arranged inside one of the cabins with the car's small side in front of the opening of the elevator compartment. An elevator is assigned to the cabin containing the vehicle, the elevator having previously carried out maneuvers so as to be provided with trolleys assigned to it by selection from among a plurality of trolleys, for each elevator. The vehicle is picked up by the assigned trolleys and is inserted in the elevator. The elevator, with the vehicle on the trolleys transfers the vehicle to the parking cell floor assigned to the motor vehicle. The trolleys with the motor vehicle placed thereupon slide outside the elevator to take the vehicle in front of the entrance of the parking cell. The elevator is in this way freed from both the trolleys and the vehicle. The trolley which places the car in the parking cell is freed and is immediately available for new maneuvers.

In a particularly simple and advantageous embodiment of this system, the loading floor is made up of one or more modules, each module having one or more loading/unloading cabins with two or more compartments and one pedestrian waiting area communicating between them. Tracks or sorting lanes are provided, as well as an entrance and an exit to and from the outside. Moreover, the elevator and the trolleys are advantageously moved independently of each other in such a way that the operation of the trolleys and of the elevator with a vehicle occurs at maximum operating speed. To obtain this result, each operating phase is preferably coordinated and controlled with the aid of a main computer or control unit.

A preferred system according to the invention, includes:

One or more modules forming a loading floor, each module having one or more loading/unloading cabins including an elevator compartment and a car space, one or more pedestrian waiting areas and tracks or lanes for entrance, transfer, and exit of motor vehicles. One or more elevators move motor vehicles vertically. Two or more transferring trolleys are provided in a plane perpendicular to the vertical movement of the elevators. Mobile comb-like supports for the motor vehicles are provided for one or more of the trolleys. Fixed comb-like supports are provided for each parking cell or carport.

Comb-like supports are provided for the vehicle inside the car space of the loading/unloading cabin, and include two or more pieces that can be opened to allow the passage of the trolleys during motor vehicle transfer from the car space to the elevator compartment.

The invention has many advantages such as: a considerable increase in the operating capacity due to the excellent use of available spaces; a surprising increase of the speed of the parking and recovery of the motor vehicles due to the optimal arrangement of the structural and transferring elements inside the available spaces; and consequently a substantial reduction in energy consumption and running costs, due to, among other things, the high computerization of the system.

Other features and advantages of the present invention will become apparent from the following description of the invention which refers to the accompanying drawings.

DETAILED DESCRIPTION OF THE PREFERRED EMBODIMENTS

Figure 1A:
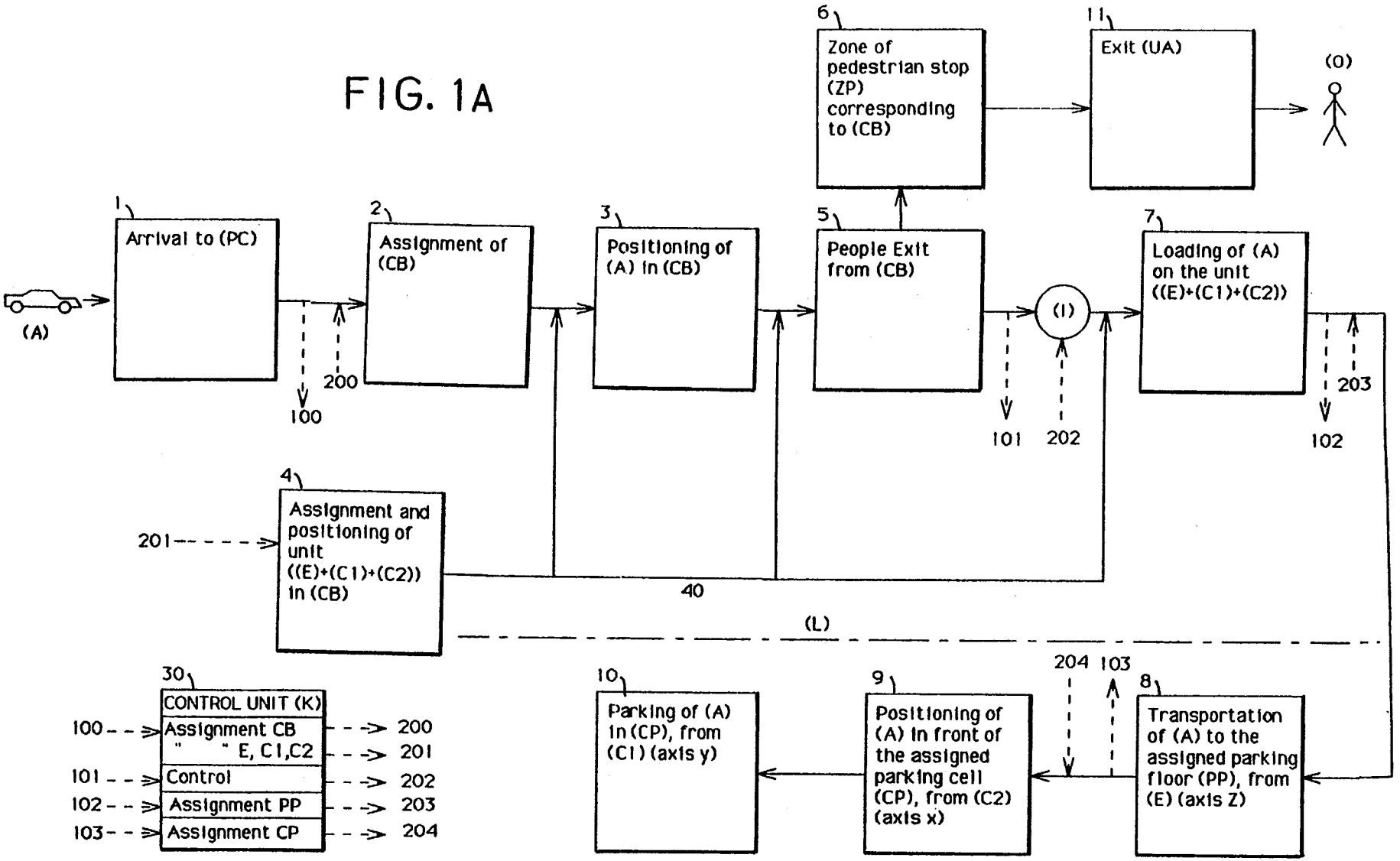
FIGS. 1A, 1B and 4 are block diagrams illustrating the main phases of the overall system, as well as certain particular aspects; they illustrate the totality of the system's operations according to the invention, both with regard to the vehicle and respective driver, and to the movements of the automatic transfer device for the vehicle itself.

Referring now to FIG. 1A, there is shown how a vehicle (A) arrives at a pick-up point or loading floor (PC), which, according to a first aspect of the invention, simply consists of at least one arrival track or sorting lane (CS) and a cabin, with the exclusion of ramps, waiting areas and the like of conventional silos. In effect, as seen from FIGS. 2 and 3, the vehicles (A), coming from the outside of the silos, now simply moves in front of the assigned cabin (CB1) using, for example, the sorting lane (CS1).

Referring back to FIG. 1A, after the arrival phase at the pick-up point (PC) (block 1), the assignment of the cabin (CB) for the vehicle (A) is carried out in block 2. Consequently the car (A) is put in a suitable position for its transfer in cabin (CB) (block 3). Block shows how, once the signal (201) is received in response to the signal (100) sent, for example, from an entry sensor, the assignment and positioning of the trolleys (C1) and (C2) is carried out for a certain elevator (E) in the cabin previously assigned (CB).

On the basis of the signals transmitted on line (40) from block 4, in block 5 people (O) exit from the cabin (CB). People (O) arrived with the vehicle (A) and, as shown in block 6 and in FIGS. 2 and 3, move towards the exit (UA) (block 11 in FIG. 1A) and from there to the outside of the silos. At this point, after checking for the absence of people inside the vehicle space (VA) of the cabin (CB) by using signals (101), (202), and element (I), loading of the vehicle (A) is carried out (block 7) on the transferring unit which is elevator (E) and trolleys (C1) and (C2) which are brought about at any stage between block 2 and block 7 and is in the elevator compartment (VE) of cabin (CB).

After authorization from control unit 30 by signal (203) in response to signal (102), the transferring unit (elevator (E), trolleys (C1) and (C2) and vehicle (A)), see block 8, is taken to the assigned parking floor (PP). In block 9, the vehicle (A), which has moved vertically or along a Z axis, is positioned by horizontal movement along an X axis by a trolley, for example (C2), in front of an assigned cell or carport (CP) (in accordance with signals (103) and (204) from controller 30). In block 10, the car (A) placed at the entrance of cell (CP) is parked in the cell (CP) by horizontal movement along a Y axis by a trolley, for example (C1).

Figure 1B:
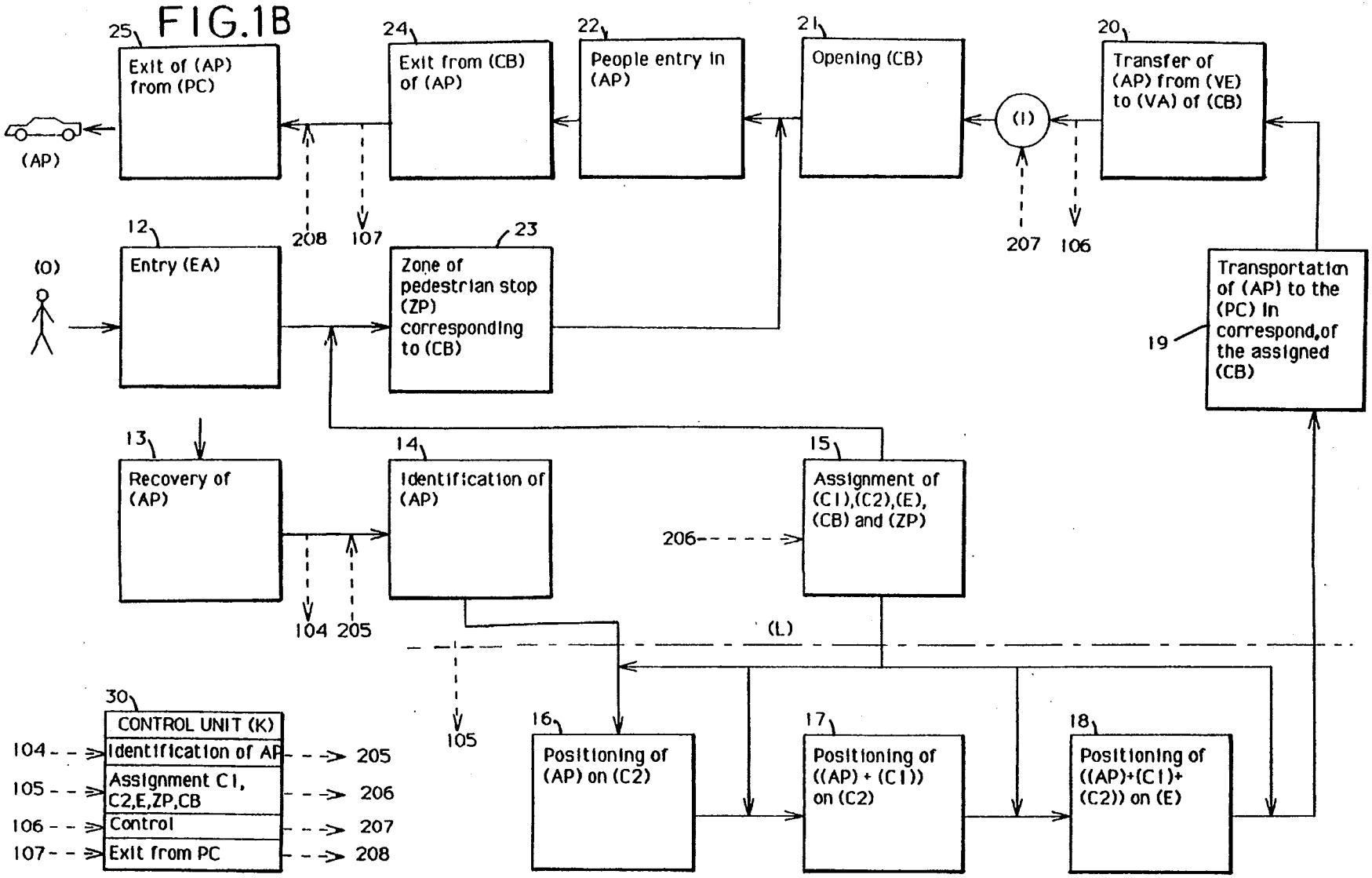

In FIG. 1B the sequence of operations for the recovery of a vehicle (A) to be returned to a client (O) is shown. In block 12, a client enters the silos and, for example, with a magnetic card specifies in block 13 the number or coordinate of a parked car (A). Consequently, in block 14 identification of the car (A) occurs as requested by the client (O) due to signals (104) and (205).

According to a feature of the invention, immediately after the identification carried out in block 14, the more characterizing phase of the invention starts. As soon as the computer or control unit (k) in block 30 receives the signal (105), it instantaneously puts into action the operation which best accelerates the movement, the capacity and efficiency of the system by signal (206). In block 15, signals are given to the elevator (E) to retrieve trolleys (C1) and (C2) that are most easily accessible, as well as to address them to the preselected cabin (CB), and signals are sent to the user (O) indicating which pedestrian waiting area (ZP) for retrieval of vehicle (A).

In block 16, the parked car (A) is positioned on the trolley (C1) which in its turn repeats the operation of block 10 of FIG. 1A in the opposite direction, i.e. the loading of parked car (AP) on trolley (C1) and the transfer of the latter along axis Y.

In the following block 17, the parked car (AP) and related trolley (C1) pass on to the second trolley (C2), which is moved along Y axis in analogy with the operation of block 9 of FIG. 1A.

In block 18, positioning of the parked car (AP) and trolleys (C1) and (C2) on the elevator (E), is carried out.

In block 19, the transport operation of parked car (AP) to the loading floor (PC) is carried out in relation to the cabin (CB) assigned in block 15.

Subsequently, in block 20 the unloading of the parked car (AP) from elevator (E) and trolleys (C1) and (C2) from the elevator compartment (VE) to the car space (VA) of cabin (CB) is carried out.

After the appropriate checks, see, for example, signals (106) and (207) and element (I), in block 21 the opening of the cabin (CB) is carried out; in block 22 permission for people (O) to enter the parked car (AP) is given; users (O) are coming from the corresponding pedestrian waiting area (ZP) (block 23). Then in block 24 exit of the parked car (AP) from the cabin (CB) is carried out, and in block 25 there is a guided exit step using the lane (CVA), preselected by signals (107) and (208) from the loading floor (PC) to the outside of the silos.

The point section line (L) in FIGS. 1A and 1B preferably represent the separation between the loading floor (PC) and the parking floor (PP) located under the loading floor (PC) (underground silos).

Figure 2:
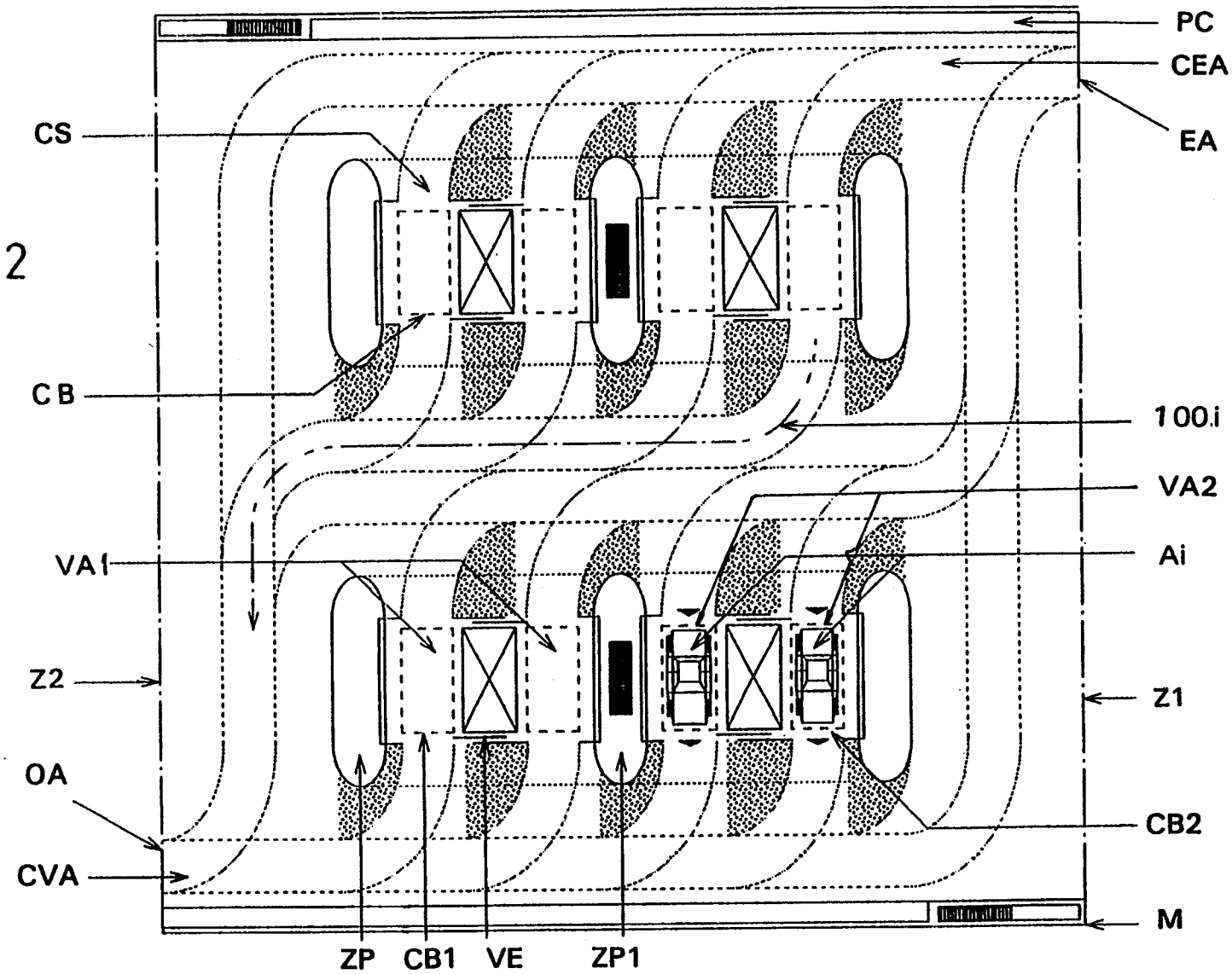
FIGS. 2 and 3 are schematic and partial front views of two different types of modules forming a loading floor that illustrate in more detail blocks 1 and 25 of FIGS. 1A and 1B, respectively.
Figure 3:
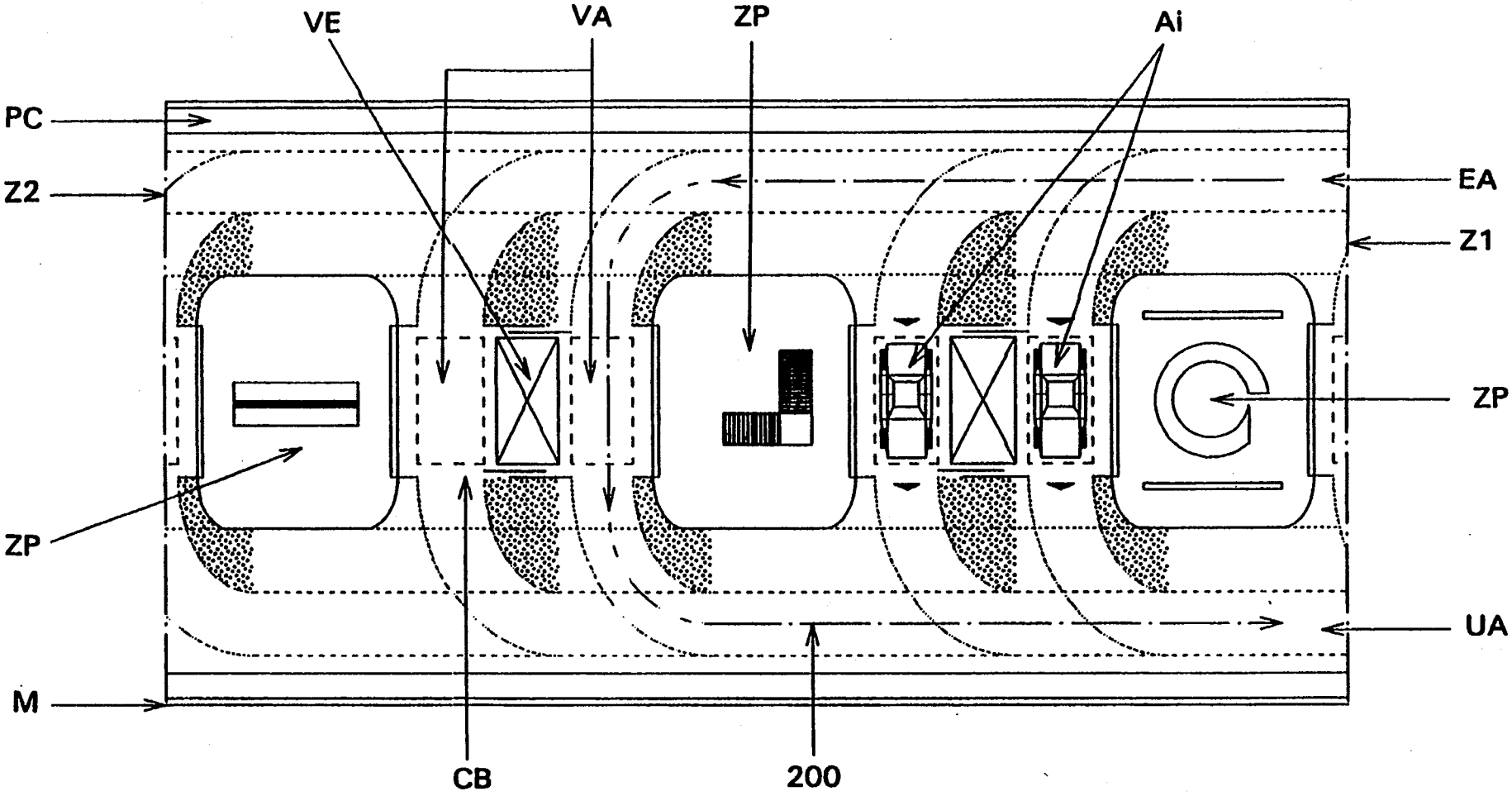

In FIGS. 2 and 3, two different types of modules (M) are represented, which form the loading floor (PC), that according to the size of the place and the type of available territory can be formed, for example, of a minimum of one to an optimal number of ten modules (M). Preferably, the module (M) is a complete unit, that includes: one or more pedestrian waiting areas (ZP), one or more loading/unloading cabins (CB) one or more car spaces (VA) for initial positioning and recovery of vehicle (A) and a portion or elevator compartment (VE) that gathers the elevator (E) and trolleys (C1) and (C2). Each module also contains one or more tracks or lanes of entrance (CE), of movement (CS) and exit (CVA) for the optimal inflow and outflow of vehicles to be accommodated, as well as an entrance (EA) and an exit (UA) with the outside.

Preferably the pedestrian waiting area (ZP) is common to two cabins (CB), for example, the pedestrian area (ZP1) in FIG. 2 borders the car spaces (VA1) and (VA2) associated with cabins CB1 and CB2, respectively. The exit (UA) of the vehicles (A) is on one side (Z2) different from side (Z1) from the entrance (EA) of the loading floor (PC). In this case the vehicles (A) travel on double S-shaped routes indicated, for example, at 100*i*. The exit (UA) and entrance (EA) of the loading floor (PC) may be on the same side (Z1) (see FIG. 3). The vehicles (A) therefore travel on U-shaped routes indicated, for example, at 200.

Figure 4:
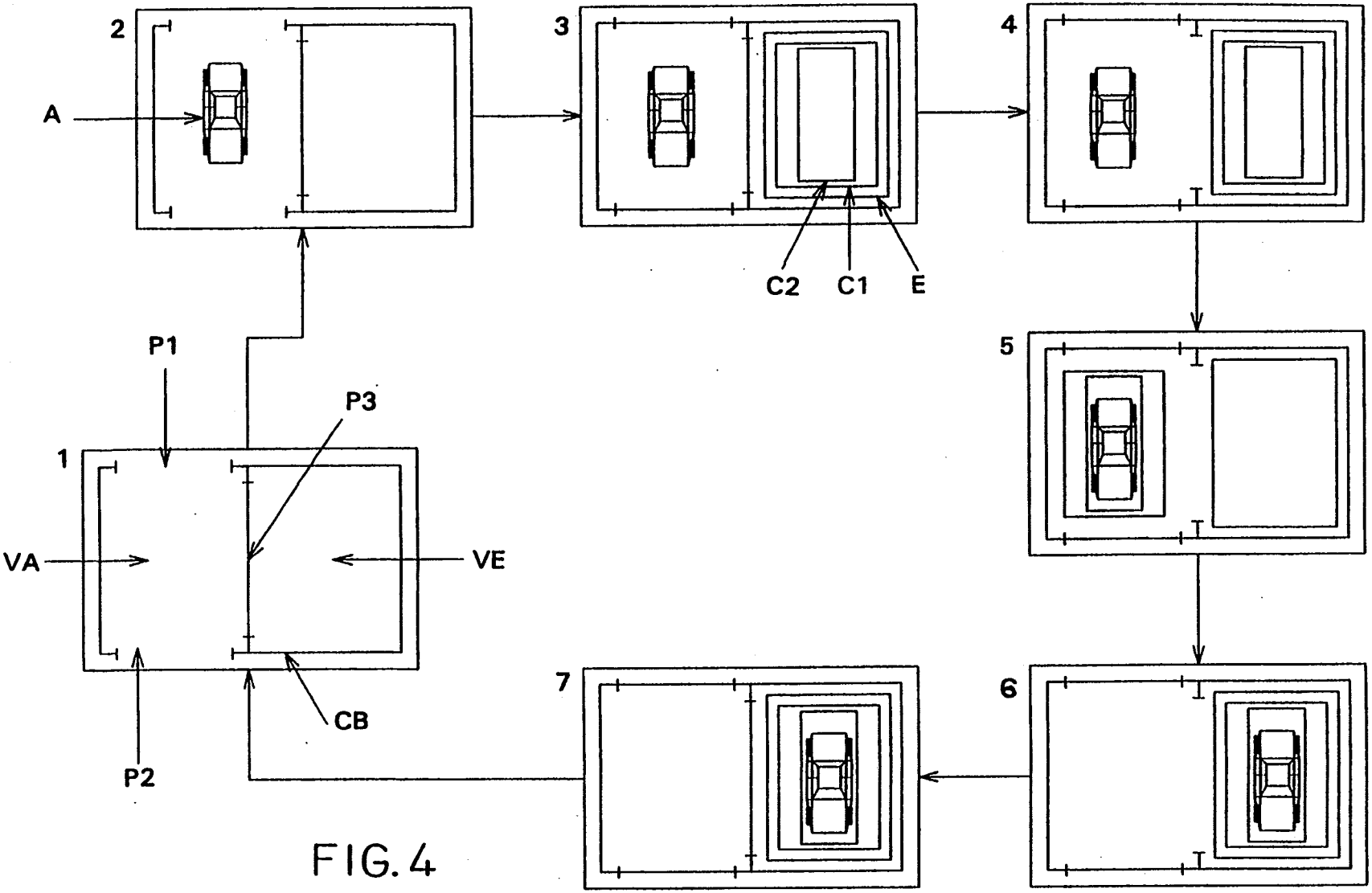

FIG. 4 shows, by way of block diagrams, the operating phases regarding the loading/unloading of cabin (CB) (blocks 2, 3, 4 and 7 of the block diagram of FIG. 1A). Repeating the steps in the direction opposite to that indicated by the arrow corresponds to blocks 15, 19, 20 and 24 of the block diagram of FIG. 1B.

Phase 1 (of FIG. 4) shows a cabin (CB) having two compartments with the elevator space (VE) and the car space (VA) empty. Doors (P1) and (P2) are open for entrance of a vehicle (A), coming from (PC), to the inside of the car space (VA) of cabin (CB), see phase 2.

Phase 3 includes the arrival of a unit including elevator (E) and trolleys (C1) and (C2) inside the elevator compartment (VE) of cabin (CB), with closing of doors (P1) and (P2). Once the communication door (P3) between spaces (VE) and (VA) (phase 4) is open, the trolleys (C1) and (C2) move under vehicle (A) positioned in space (VA) (phase 5).

Phase 6 provides for the transfer of the trolleys (C1) and (C2) with the vehicle (A) on the elevator (E) in (VE). In phase 7, the communicating door (P3) is closed, the elevator (E), and trolleys (C1) and (C2) supporting the vehicle (A) moves towards a parking floor, clearing cabin (CB) so that it is ready to repeat the steps discussed above.

Figure 5:
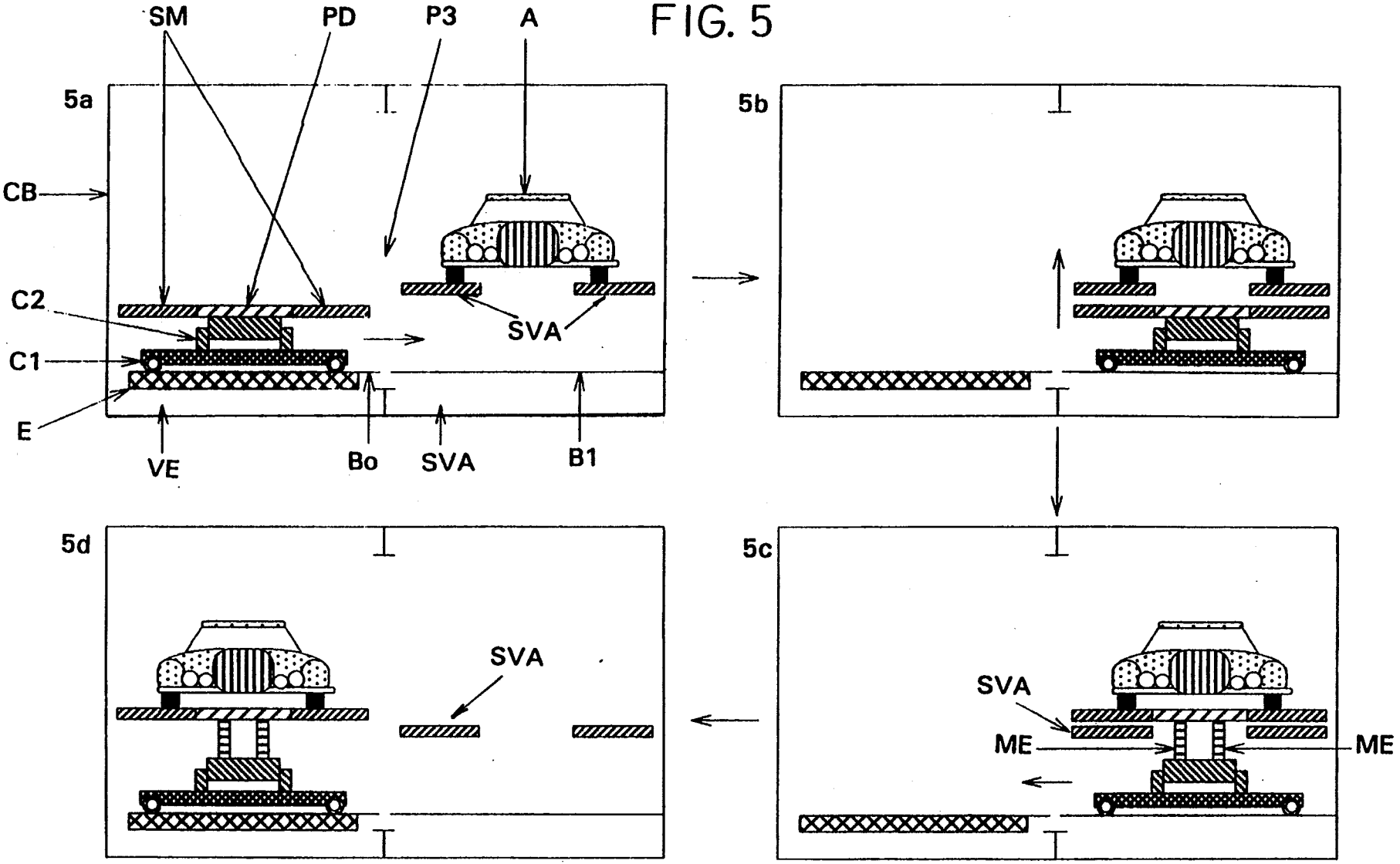
FIG. 5 shows schematic front views representing the loading maneuver for a motor vehicle in a loading/unloading cabin, illustrating in more detail block 7 of FIG. 1A.

FIG. 5 is representative of a particular aspect of the system, more precisely, the loading and transferring phase of a motor vehicle (A) from the car space (VA) to the elevator compartment (VE) of a cabin (CB) with two compartments. These figures refer to block 7 of FIG. 1A and phases to 4 to 6 of FIG. 4.

In position 5*a* motor vehicle (A) is positioned on comb-like supports (SVA) of the car space (VA), elevator (E) and trolley (C1) and (C2) are positioned in the elevator compartment, and the communicating door P3 between the spaces is open. The elevator (E) is provided with transversal tracks (Bo) that are in contact with the corresponding tracks (B1), which are also transversely placed inside space (VA). The tracks are needed for the movement of the trolley (C2) from space (VE) to space (VA) and vice versa, and are therefore placed at a height suitable for this purpose, thereby allowing the trolley (C1), placed above trolley (C2), to be positioned under the supports (SVA) of space (VA). The trolley (C1) is also made up of, in the upper part, a central mobile platform (PD) and mobile supports (SM) placed at the longitudinal ends of the platform (PD).

The loading and transferring phases of vehicle (A) from the car space (VA) to the elevator compartment (VE) are explicitly shown in the remaining positions 5*b* to 5*d*. In position 5*c*, the supports (SM) of the trolley (C1) are shown equipped with elevator means (ME), that lift the motor vehicle (A) after having passed through the supports (SVA) due to the fact that the supports (SM) and (SVA) have an offset comb-like configuration.

Figure 6A:
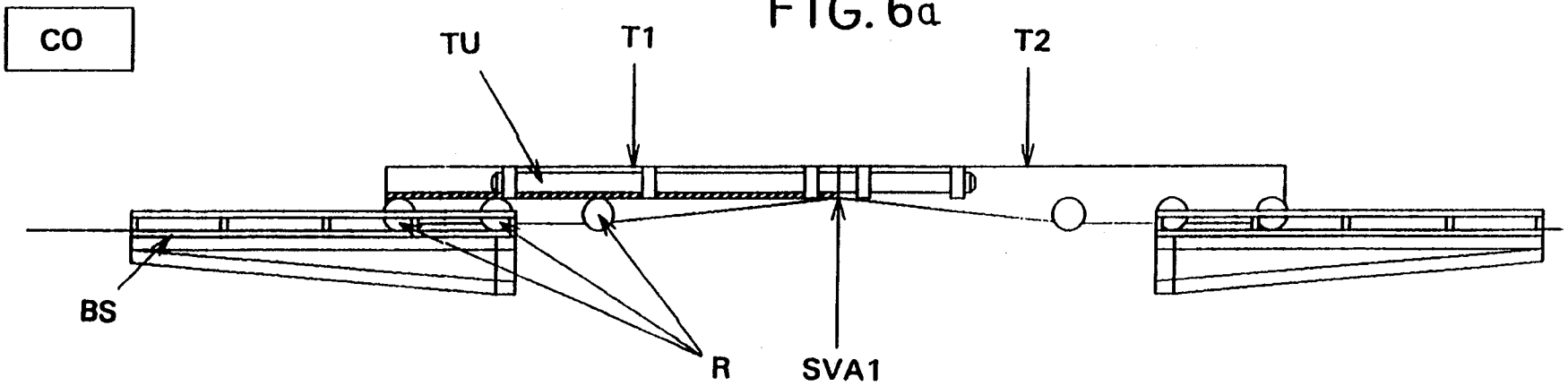
FIGS. 6A and 6B are partial and schematic front views in prospective of the comb-like support device which can be opened and closed for clearance of trolleys from the car space of a corresponding cabin, in two distinctive positions.
Figure 6B:
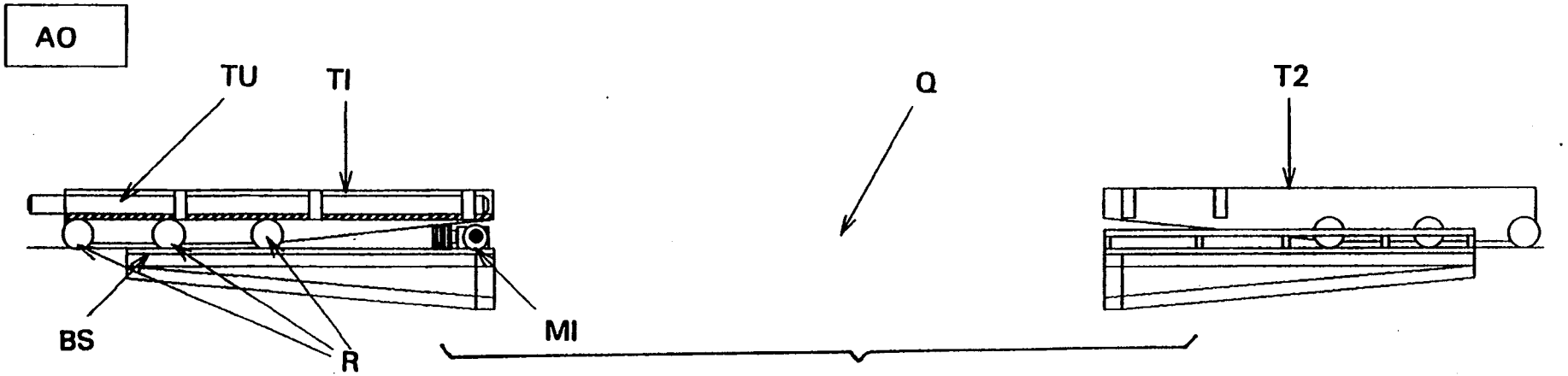
Figure 7:
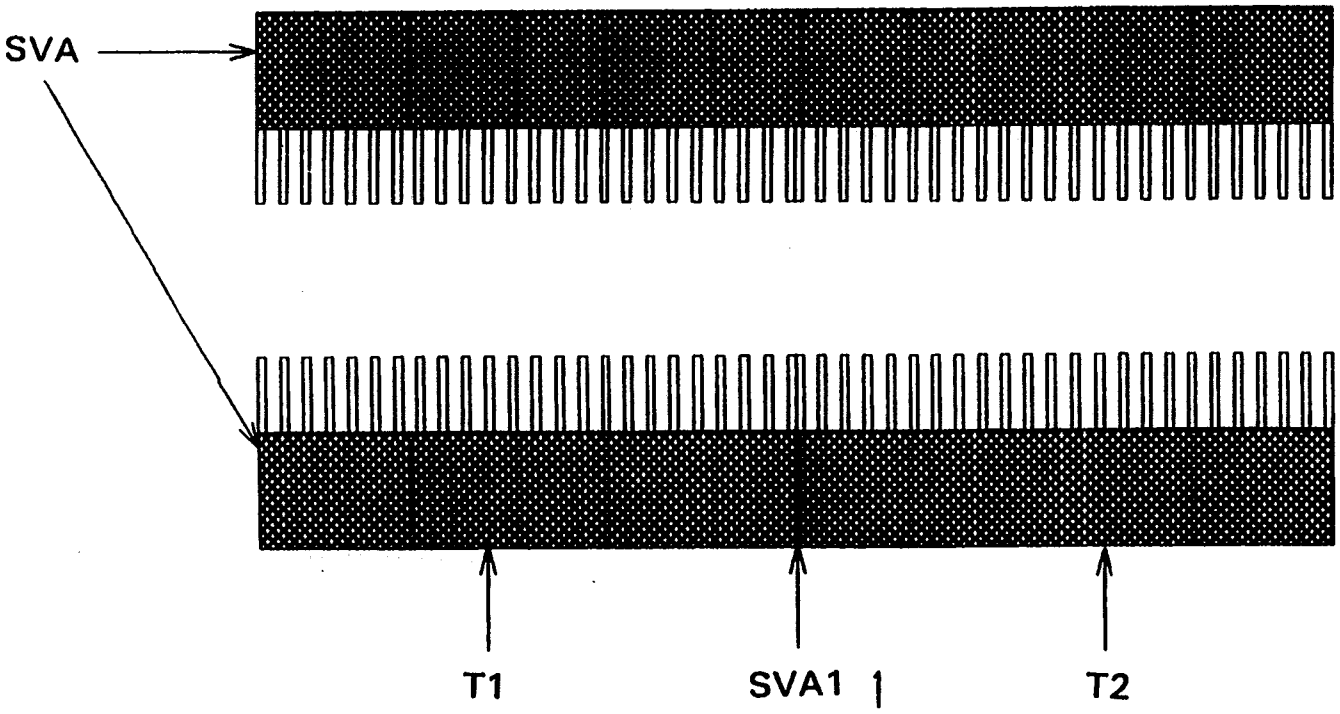
FIG. 7 is a top view of the comb-like support device.

In FIGS. 6*a* and 6*b* one of the comb-like supports (SVA) is represented. It is formed of two pieces (T1) and (T2) that can be opened to allow trolleys (C1) and (C2) carrying vehicle (A) into aperture (Q) during the vehicle (A) transfer operation from the car space (VA) to the elevator compartment (VE) and vice versa. Positions (CO) and (AO) of FIG. 6 correspond to the positions of the support (SVA) in positions 5*c* and 5*d*, respectively. The pieces (T1) and (T2) of the element (SVA1) are advantageously equipped with: a device for movement, for example, wheels (R), tracks (BS) for the running of the wheels (R), and motors (MI) for the movement of the pieces (T1) and (T2) along the tracks (BS); and support elements for example, periscopic tube (TU), to support pieces T1 and T2. As shown in FIG. 7, each piece of the support (SVA) has intermeshing fingers.

The detailed phases of the system represented by blocks 8, 9 and 10 of FIG. 1A and of blocks 16, 17 and 18 of FIG. 1B, have already been described in a copending patent application by the same inventor and are therefore not shown.

The structure discussed in the earlier patent application which is preferably used in the present inventions are: comb-like mobile supports for a vehicle with a trolley; and comb-like fixed supports for a vehicle in the cells or carports.

Therefore the above-mentioned earlier patent application can be considered as being incorporated in, or an integral part of, this description. However, in comparison with what is described in the previous application, the advantageous characteristic of the present invention relates to the fact that by equipping the silos with a loading floor formed of several modules, and by providing devices, as for example, motor vehicle supports in several pieces which can be opened and closed, it is possible to reach a maximum availability of the movement elements with consequent acceleration of parking operations.

I claim:

1. An automated parking system for parking motor vehicles in a silo, including cells, carports, corridors, and ramps, the motor vehicles being carried using lifting and translating means including at least one elevator and at least two trolleys, the system comprising:

a plurality of parking cell floors including parking cells for parking the motor vehicles;

a plurality of loading and unloading cabins, each of said cabins including an elevator compartment and a car compartment, said elevator and car compartments being arranged side-by-side in each of said cabins;

elevator means movable between the elevator compartment and the parking cell floors;

means for placing a motor vehicle at a loading floor with access to the loading and unloading cabins and the elevator compartment;

means for placing a motor vehicle inside the car compartment of one of the cabins;

trolley means movable within the cabin between the elevator and car compartments for placing the motor vehicle located in the car compartment of the cabin on the elevator means located in the elevator compartment; and means for moving the trolley means with a motor vehicle thereupon from one of the cabins into one of the parking cells.

2. The system according to claim 1, further comprising at least one module, each module having at least one loading and unloading cabin and at least two communicating compartments, at least one pedestrian waiting area, sorting lanes, and an entrance and an exit to the outside.

3. The system according to claim 1, further comprising means for independently moving the elevator means and the trolley means.

4. The system according to claim 1, further comprising a main computer for controlling the system.

5. A silo for an automated parking system for parking motor vehicles into a plurality of parking cells, comprising:

at least one module including at least one loading and unloading cabin having an elevator compartment and a car space disposed alongside the elevator compartment in the cabin, at least one pedestrian waiting area, and tracks for entrance, transfer, and exit of the motor vehicles;

at least one elevator for vertical movement of the motor vehicles;

at least two transferring trolleys movable within the cabin between the elevator compartment and the car space for moving the motor vehicles between the elevator compartment and the car space and for loading and unloading motor vehicles from the cabins;

comb-like mobile supports for supporting a vehicle, each of the mobile supports being associated with at least one of the trolleys;

corresponding comb-like fixed supports associated with each parking cell;

comb-like car space supports for supporting a vehicle inside the car space of the loading and unloading cabin including at least two pieces that can be opened to allow passage of the trolleys through an aperture between the pieces during vehicle transfer from the car space to the elevator compartment.

* * * * *

UNITED STATES PATENT AND TRADEMARK OFFICE

CERTIFICATE OF CORRECTION

PATENT NO. : 5,338,145

DATED : August 16, 1994

INVENTOR(S) : Fausto BERETTA

It is certified that error appears in the above-indentified patent and that said Letters Patent is hereby corrected as shown below:

On the title page, should read, item [30] Foreign Application Priority Data Sept. 28, 1990 [CH] Switerland.....03117/90

Signed and Sealed this

Fourth Day of October, 1994

*Attest:*

*Attesting Officer*

BRUCE LEHMAN

*Commissioner of Patents and Trademarks*